US006666043B2

(12) United States Patent
Lee

(10) Patent No.: US 6,666,043 B2
(45) Date of Patent: Dec. 23, 2003

(54) DEWFALL PREVENTING DEVICE OF REFRIGERATOR

(75) Inventor: Myung Ryul Lee, Gyeonggi-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/244,760

(22) Filed: Sep. 17, 2002

(65) Prior Publication Data

US 2003/0209025 A1 Nov. 13, 2003

(30) Foreign Application Priority Data

May 7, 2002 (KR) ..... 2002-25099
May 7, 2002 (KR) ..... 2002-25100
May 20, 2002 (KR) ..... 2002-27699

(51) Int. Cl.[7] ..... F25B 5/00; F25B 41/00
(52) U.S. Cl. ..... 62/283; 62/277; 62/81
(58) Field of Search ..... 62/272, 248, 283, 62/275, 276, 277, 81, 176.1, 176.6, 440

(56) References Cited

U.S. PATENT DOCUMENTS 3,984,223 A * 10/1976 Whistler, Jr. ..... 62/81
4,009,586 A * 3/1977 Skvarenina ..... 62/80
5,255,531 A * 10/1993 Williams et al. ..... 62/277
5,826,442 A * 10/1998 Lee ..... 62/283

FOREIGN PATENT DOCUMENTS

JP 53130560 A * 11/1978 ..... F25D/21/04

* cited by examiner

*Primary Examiner*—Chen Wen Jiang
(74) *Attorney, Agent, or Firm*—Greenblum & Bernstein, P.L.C.

(57) ABSTRACT

There is provided a dewfall preventing device of a refrigerator for preventing dew from forming on the contact portion of a refrigerator case and a door, the device comprising a heat exchanger for concentrating the waste heat generated from a compressor with contacted to the compressor of the refrigerator and a thermosyphon, its two ends connected to the heat exchanger, and having a working fluid phase-transferred into a gas phase after heat-exchanging with the waste heat from the compressor, move along the hot line, vaporize the dew forming on the contact portion of a refrigerator case and a door by the radiation of the heat, transferred into a liquid phase, fallen down by gravitation, and introduced back into the heat exchanger.

25 Claims, 12 Drawing Sheets

DEWFALL PREVENTING DEVICE OF REFRIGERATOR

This application claims the benefit of the Korean Application Nos. P 2002-0027699, P 2002-25099, P 2002-25100 filed on May 20, 2002, May 7, 2002, May 7, 2002, which is hereby incorporated by reference.

BACKGROUND OF THE INVENTION

1. Field of the Invention

The present invention relates to a refrigerator, and more particularly, to a dewfall preventing device of a refrigerator for preventing the dewfall phenomenon occurring on the contact portion of the front side and a door of the refrigerator by the hot heat of a compressor of the refrigerator.

2. Discussion of the Related Art

Generally, a refrigerator is used to freeze or cool foods, and its schematic structure is illustrated as follows.

FIG. 1 illustrates a side sectional view of a conventional refrigerator.

Referring to FIG. 1, a refrigerator includes a case forming a receiving space divided into a freezing room 101 and a cooling room 102, a door 12, which is installed on the front side of the case 10 to open/close the freezing room 101 and the cooling room 102, and units such as a compressor 20, a condenser 30, and an evaporator 40, etc. to form a freezing cycle.

In the refrigerator, a gas refrigerant of low pressure and temperature is compressed into high pressure and temperature by the compressor 20, and the compressed gas refrigerant of high pressure and temperature is transferred into a liquid phase of high pressure by being cooling-compressed while passing the condenser 30. While the liquid phase of the refrigerant of high pressure passes through a capillary tube or an expander (not shown), its temperature and pressure are decreased. While the liquid refrigerant is transferred into a gas of low pressure and temperature in the evaporator 40, it extracts the heat from the cooling room and the freezing room to cool the air there inside.

The evaporator 40 is installed inside a vaporizing room 103 that is a separate space of the back of the freezing room 101. The air cooled by the evaporator 40 is introduced into the freezing room 101 and the cooling room 102 and circulated therethrough by the operation of the fan 50 installed in the vaporizing room 103 to drop the temperature of the freezing room 101 and the cooling room 102.

Generally, dew forms on the front end side of the case 10 which contacts the door 12 due to the temperature difference with the outside when opening the door 12 of the refrigerator because of the characteristics of the freezing room 101, which is referred to as dewfall phenomenon.

To prevent the above dewfall phenomenon, a hot line (referring a numeral 70 of FIG. 2) is normally installed in the refrigerator.

FIG. 2 illustrates a flow line of the hot line of the conventional refrigerator.

Referring to FIG. 2, the hot line (dotted line) 70 comes out from an input end of the condenser 30 installed in a machinery room, circulates the case 10, and goes into the output end of the condenser 30. That is, the hot line 70 is a secondary condensing tube installed on the interior front side of the case 10, which circulates the contact portion of the door 12 and the case 10.

Therefore, according to the conventional technology, a part of the refrigerant gas of high pressure and temperature discharged from the compressor 20 is introduced into the hot line 70. Then, the front side portion around the hot line 70 in the case 10 is heated over a room temperature thereby to prevent the dewfall phenomenon on the front side of the case 10 even with the opening of the door 12.

However, a cooling load is increased in the conventional refrigerator, that is, the refrigerant gas of high pressure and temperature discharged from the compressor 20 is used as the working fluid of the hot line 70, and the overall front side of the case 10 is heated over a high temperature unnecessarily, and the heat generated from the hot line 70 is transferred into the freezing room 101 and the cooling room 102.

In addition, a frictional heat of a high temperature is generated from the compressor 20, and the frictional heat has a bad effect on the compressor 20, itself thereby to reduce the operation performance of the compressor 20.

In addition, the heat generated from the compressor 20 is not used appropriately, and wasted to the outside resulting in causing a loss of energy and reducing the efficiency of the refrigerator.

In addition, besides the circulation cycle of the refrigerant basically incorporating only the compressor 20, the condenser 30, the evaporator 40, and the expansion valve in the conventional technology, the additional refrigerant is necessary by the amount passing through the hot line 70 so that the production expenses is increased and the productivity of the refrigerator is decreased.

SUMMARY OF THE INVENTION

Accordingly, the present invention is directed to a dewfall preventing device of a refrigerator that substantially obviates one or more problems due to limitations and disadvantages of the related art.

An object of the present invention is to provide a dewfall preventing device of a refrigerator by using a thermosyphon employing the hot heat generated from a compressor of the refrigerator as a heating source, and forming a hot line on the contact portion of a refrigerator case and a refrigerator door.

Another object of the present invention is to provide a dewfall preventing device of a refrigerator for efficiently discharging the hot heat generated from the compressor.

A further object of the present invention is to provide a dewfall preventing device of a refrigerator, wherein the thermosyphon is operated by a working fluid independently from a typical refrigerating cycle of the refrigerator, and the separate working fluid heat-exchanges with the heat of the cooling oil of the compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dewfall preventing device of a refrigerator may include a compressor for compressing a refrigerant; a heat exchanger for extracting the heat generated from the increase of the refrigerant inner energy by the friction and the compression in the compressor; a thermosyphon for maintaining the contact portion of a refrigerator case and a refrigerator door at a predetermined temperature by a way that a working fluid phase-transferred into a gas phase in the heat exchanger radiates the extracted heat, and after releasing the extracted heat, the cooled working fluid comes back into the heat exchanger by gravitation; and a wick being placed in the pipe line of the heat exchanger for concentrating the extracted heat generated from the compressor and enabling the working fluid to easily flow.

The present invention forms a hot line by using thermosyphon in which a separate working fluid is injected without using a refrigerant gas, and reduces an air pollution due to the refrigerant gas. In addition, the production process to realize the present invention is simple without an auxiliary circulating device.

Additionally, the compressor is easily cooled, and the waste heat is reused thereby to increase energy efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The preferred embodiments of the present invention all employ a way of thermosyphon in the dewfall preventing device of a refrigerator.

The thermosyphon is a thermal circulation structure in which a working fluid is injected into the inner space of a closed case of a vacuum state, and the working fluid in the inner space is vaporized by heating one end of the thermosyphon, and the working fluid moves to the other side by the pressure difference generated by the evaporation. The working fluid radiates heat to the around and is again back to the liquid state during the compression process. The liquid phase of the working fluid comes back to the thermosyphon by gravitation.

Figure 1:
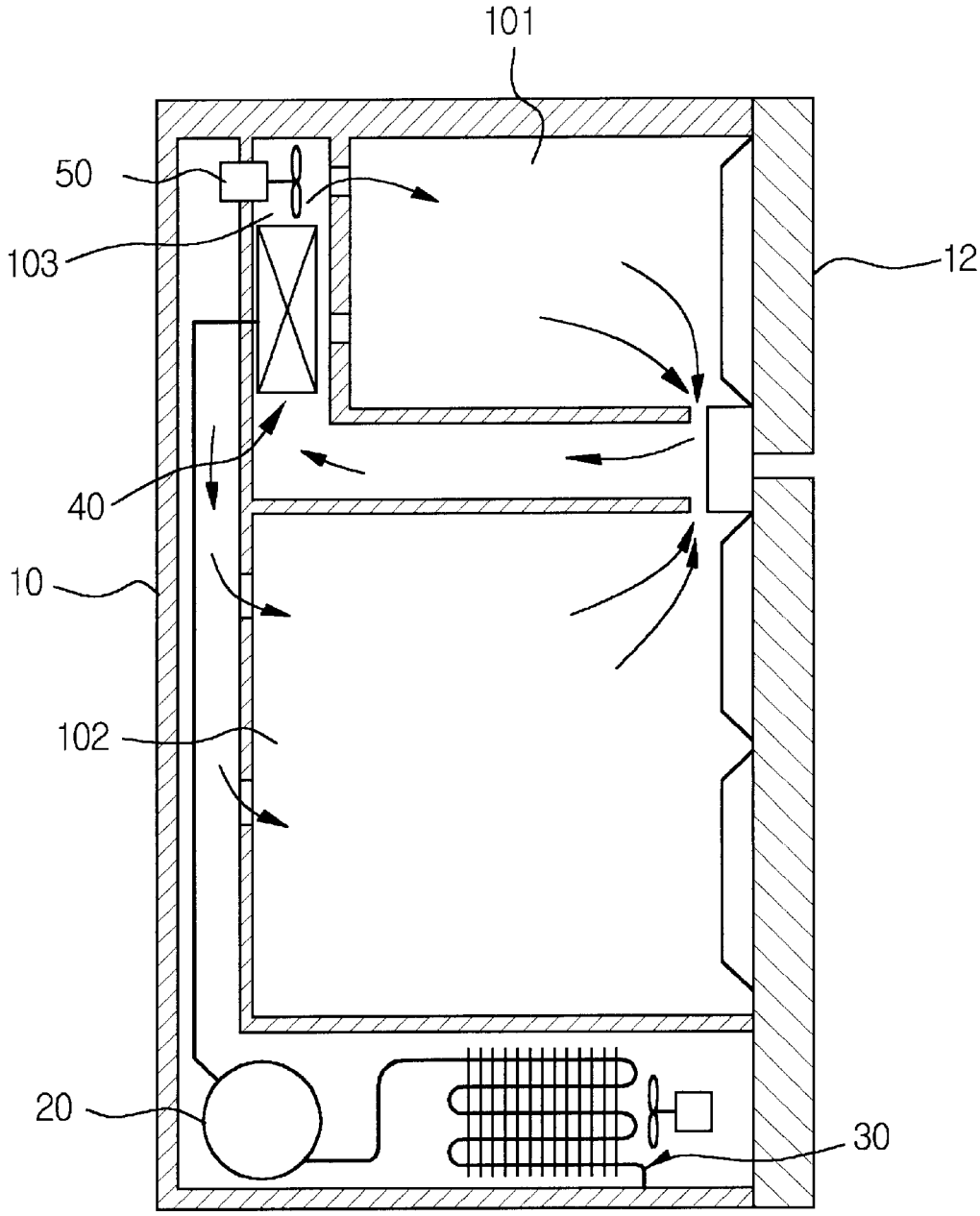
Fig. 1 (Background art)
FIG. 1 is a side sectional view of a conventional refrigerator.
Figure 2:
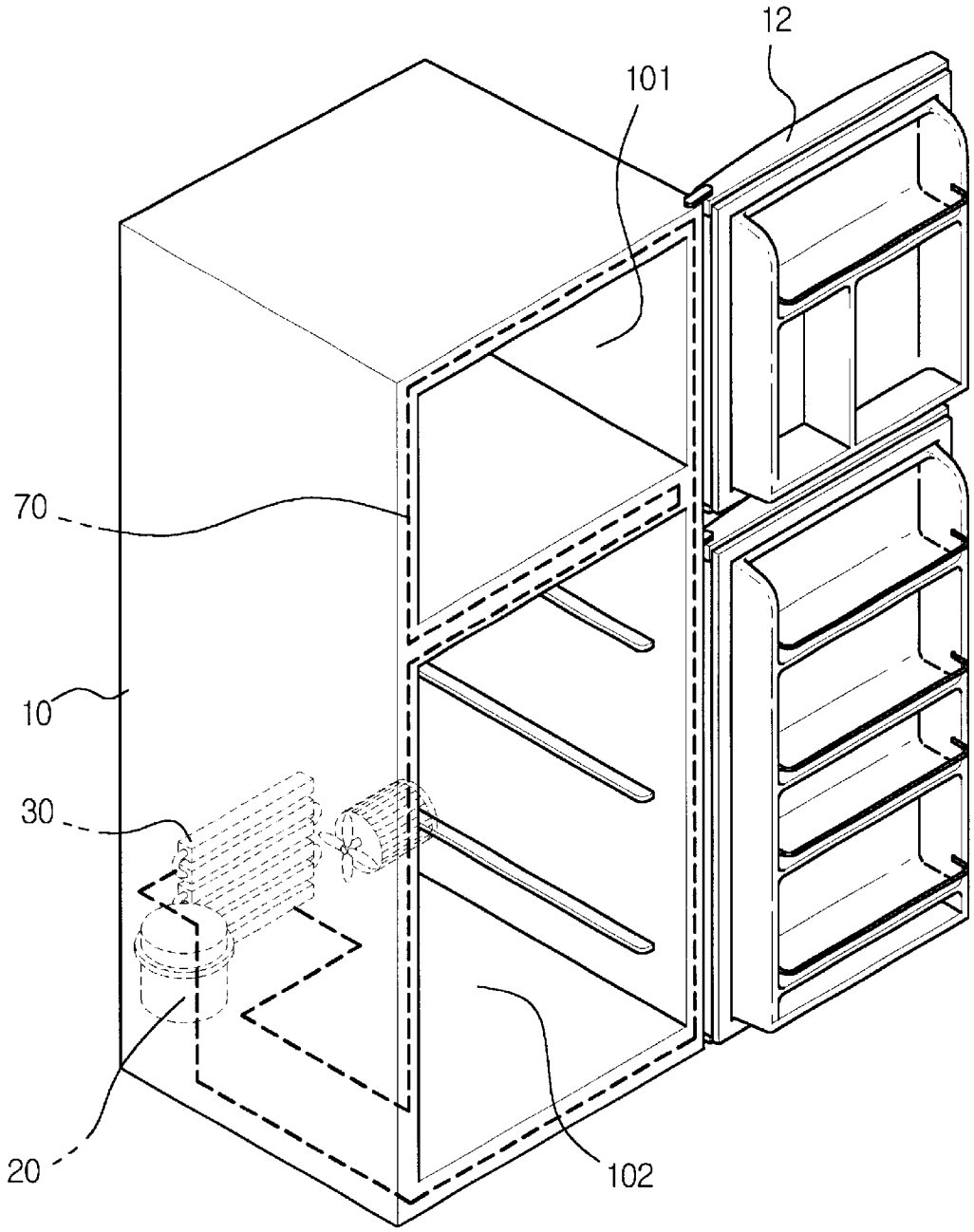
Fig. 2 (background art)
FIG. 2 illustrates the hot line used in the conventional refrigerator.
Figure 3:
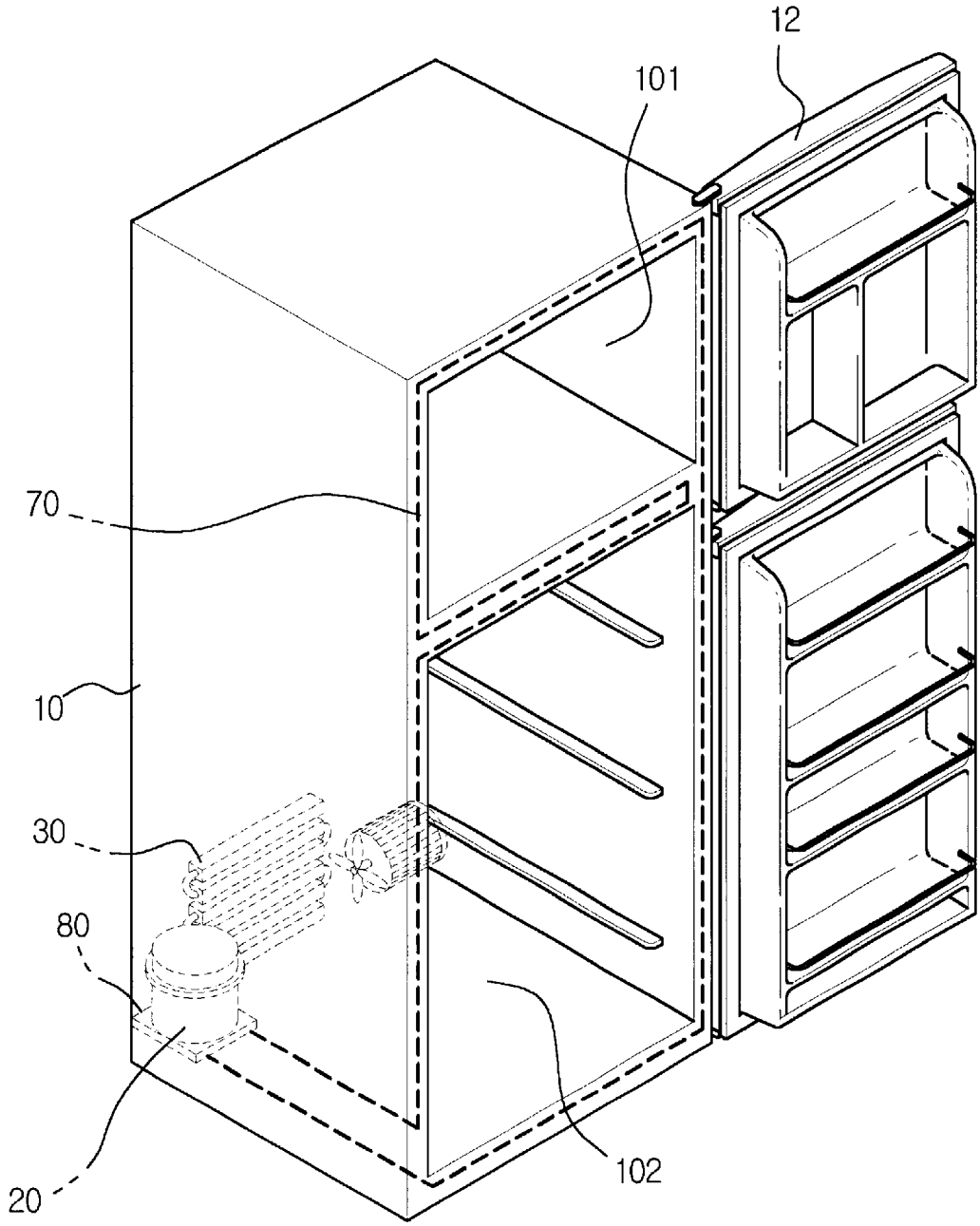
FIG. 3 illustrates that a dewfall preventing device is installed in the refrigerator according to one embodiment of the present invention.
Figure 4:
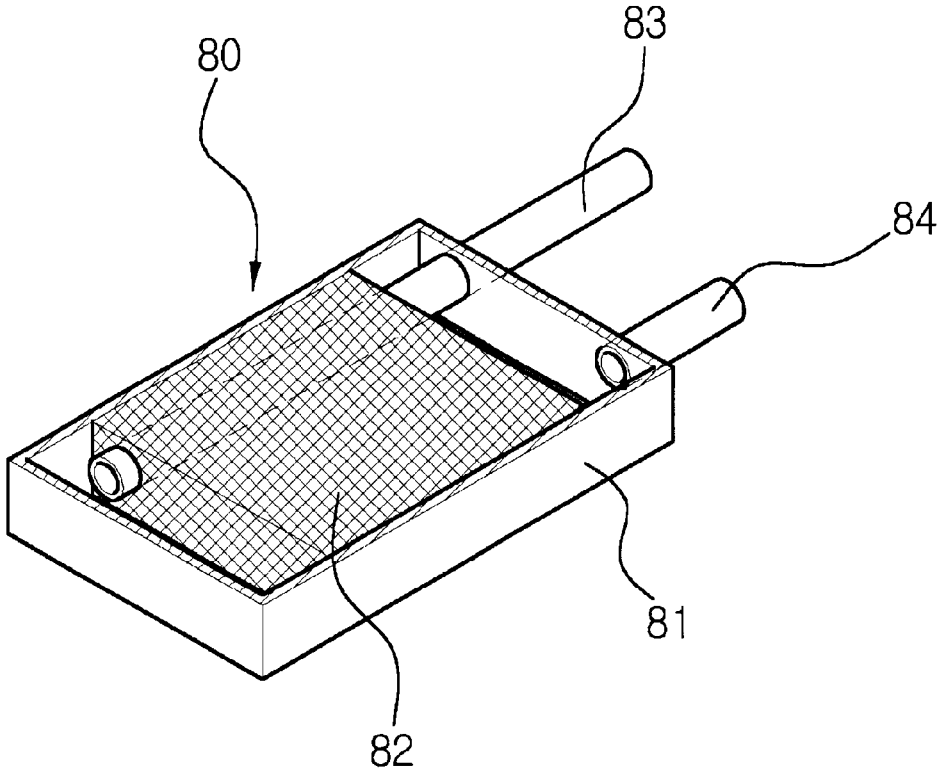
FIG. 4 illustrates a heat exchanger according to one embodiment of the present invention.

FIG. 3 illustrates that a dewfall preventing device is installed in the refrigerator according to one embodiment of the present invention, and FIG. 4 illustrates a heat exchanger according to one embodiment of the present invention.

Referring to FIGS. 3 and 4, the present invention is illustrated as follows.

The working fluid is vaporized by the waste heat of a compressor 20 inside a heat exchanger 80, which is phase-transferred from liquid to gas. The phase-transferred working fluid moves along a hot line 70 placed on the front side of a case 10 of the refrigerator and radiates heat.

The heat of the working fluid vaporizes and removes the dew from the contact portion of the case 10 and a door 12 of the refrigerator, normally operated by the temperature difference in and out of the refrigerator, and the working fluid is phase-transferred from gas to liquid by the compression. The working fluid in a liquid phase falls down back into the heat exchanger 80 by gravitation.

The present invention provides a device to prevent dew from forming on the contact portion of the case 10 and the door 12 by one directional circulation of the vaporization and the compression of the working fluid. The detailed inner structure of the present invention is illustrated as follows.

The heat exchanger 80 which is installed on the lower side of the compressor 20, concentrates the waste heat transferred from the compressor 20, and forces the working fluid, which heat-exchanges with the waste heat of the compressor 20, to be discharged into the hot line 70.

As shown in FIG. 4, the heat exchanger 80 includes a hollow outer housing 81, a wick part 82, which is placed inside the hollow outer housing 81, and concentrates the waste heat transferred from the compressor 20, and then forces the working fluid, which heat-exchanges the heat, to be easily discharged to the hot line 70, and further includes a fluid inflow pipe line 83 and a fluid outflow pipe line 84, which are placed on the inner/outer side of the outer housing 81, and through which the working fluid is introduced into the outer housing 81, and then the working fluid exchanges heat via the wick part 82, and is discharged into the hot line 70.

Particularly, the fluid inflow pipe line 83 and the fluid outflow pipe line 84, as shown in FIG. 4, have a different length. The structure allows one directional movement of the working fluid which is introduced into the outer housing 81 and exchanges the heat from the compressor 20 while passing through the wick part 82 without flowing back so that the waste heat from the compressor 20 is sufficiently transferred to the working fluid, and is discharged into the hot line 70 through the fluid outflow pipe line 84. To achieve this purpose, the fluid inflow pipe line 83 is extended inside the heat exchanger 80 and the wick part 82 with a predetermined length, and the fluid outflow pipe line 84 is placed on the outer side of the heat exchanger 80.

Preferably, an inflow port of the fluid inflow pipe line 83 is formed inside the heat exchanger 80 on the opposite side of the fluid outflow pipe line 84, and more preferably, is formed far away from the fluid outflow pipe line 84.

The wick part 82, which is placed inside the heat exchanger 80, is formed of a mesh structure to concentrate the waste heat transferred from the compressor 20, and to force the working fluid which exchanges the waste heat with the compressor 20 to be discharged into the hot line 70

The discharge of the heat-exchanged working fluid into the hot line 70 is accelerated when the pressure of the working fluid passing through the wick part 82 is decreased, and the flow velocity of the working fluid is increased by the capillary phenomenon which occurs in the wick part 82 by the surface tension of the working fluid introduced into the heat exchanger 80.

The hot line 70, as shown in FIG. 3, is figured such that a predetermined diameter of a pipe is connected to the heat exchanger 80, and installed on the front side of the case 10 with a closed loop shape. In the hot line 70, the heat of the working fluid vaporizes and removes the dew from the front side of the case 10 of the refrigerator operated by the temperature difference in and out of the refrigerator by the radiation of the working fluid, and the working fluid is phase-transferred from gas to liquid by the compression.

The working fluid in a liquid phase falls down back into the heat exchanger 80 by gravitation to complete one directional circulation with the heat-exchange of the waste heat concentrated in the wick part 82 from the compressor 20, and prevents the dew from forming on the contact portion of the case 10 and the door 12.

The working liquid functions separately from the refrigerant which is necessary to generate the cold for the refrigerating cycle. In more detail, the working liquid heat-exchanges with the waste heat from the compressor 20, which is concentrated into the heat exchanger 80, is phase-transferred from liquid to gas, and circulates to move along the hot line 70, and vaporizes the dew on the contact portion of the case 10 and the door 12 of the front side of the case 10 by the radiation so as to be phase-transferred from gas to liquid.

The working liquid of the present invention is filled in a vacuum state, and includes a water or methyl alcohol, etc., which is vaporized and condensed easily at a temperature of 0–70° C.

The function of the dewfall preventing device of the refrigerator of the present invention is illustrated as follows.

Figure 5:
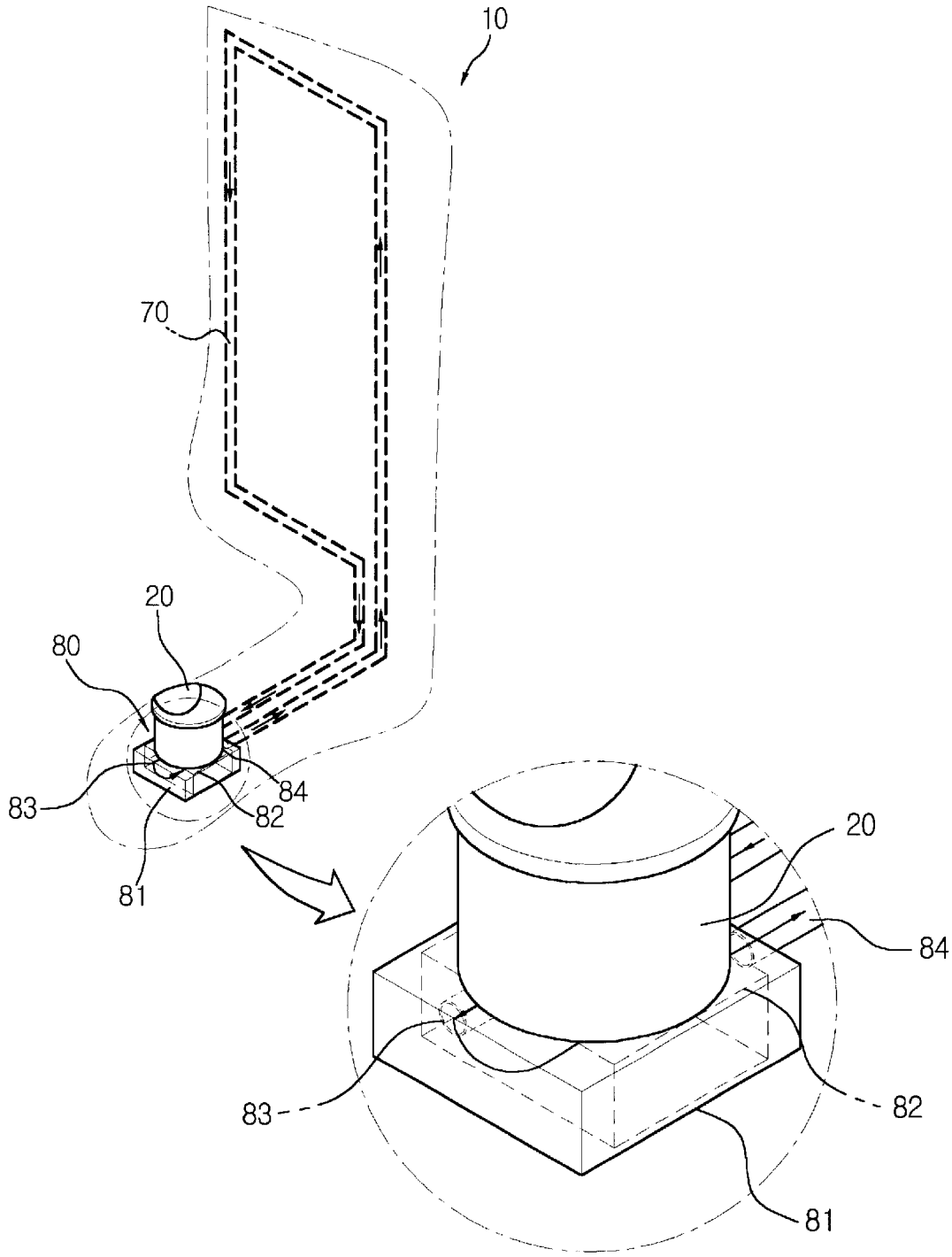
FIG. 5 illustrates the operation of the dewfall preventing device to vaporize dew according to one embodiment of the present invention.

FIG. 5 illustrates the operation of the dewfall preventing device to vaporize dew according to one embodiment of the present invention.

Referring to FIG. 5, the waste heat of the compressor 20, itself is transferred to the working fluid separately from the refrigerant to prevent the dew from forming on the contact portion of the case 10 and the door 12.

The waste heat of the compressor 20 is the heat generated when the refrigerant is compressed inside the compressor 20 to be phase-transferred to a gas state of high pressure and temperature. The heat-exchanged working fluid radiates the heat while passing along the hot line 70 installed on the front side of the refrigerator to vaporize dew forming on the contact portion of the case 10 and the door 12.

Along the moving order of the heat and the working fluid, a detailed description of the operation of the embodiment will be made below.

A high temperature of heat is generated in the compressor 20, itself by the load when the refrigerant liquid of low pressure and temperature is compressed into the refrigerant gas of high pressure and temperature. The high temperature of the heat in the compressor 20 is transferred to the wick part 82 of the heat exchanger 80 installed on the lower side of the compressor 20, and the waste heat is concentrated in the wick part 82.

The fluid inflow pipe line 83 and the fluid outflow pipe line 84 are connected to the heat exchanger 82 including the waste heat of the compressor 20, and form a closed loop with the hot line 70. The working fluid is filled inside the hot line 70 and flows there through. The working fluid is introduced through the fluid inflow pipe line 83 of the heat exchanger 80 to reach down to the other end of the heat exchanger 80, opposite to the fluid inflow pipe line 83.

The working fluid heat-exchanges with the waste heat of the compressor 20 concentrated in the wick part 82 while passing through the wick part 82 of the heat exchanger 80, and vaporizes from a liquid phase to a gas phase.

The working fluid phase-transferred to a gas phase is discharged through the fluid outflow pipe line 84 of the heat exchanger 80.

As the fluid inflow pipe line 83 and the fluid outflow pipe line 84 are placed on the opposite sides of the heat exchanger 80, the working fluid introduced into the heat exchanger 80 does not flow back into the fluid inflow pipe line 83, passes through the wick part 82 including the waste heat of the compressor 20, extracts the waste heat of the compressor 20, and is discharged through the fluid outflow pipe line 84 of the heat exchanger 80.

The discharged working fluid moves along the hot line 70 installed on the front side, the case 10 of the refrigerator as a closed loop shape, and radiates the heat to vaporize and remove the dew forming on the contact portion of the case 10 and the door 12. The working fluid goes through a condensation which is phase-transferred from gas to liquid.

The working fluid of a liquid phase, which is phase-transferred by the condensation, and falls down back to the heat exchanger 80 by gravitation, and the introduced working fluid again heat-exchanges with the waste heat of the compressor 20, which is concentrated into the wick part 82, to establish one circulation cycle.

The heat exchanger 80 illustrated in the drawings of the present invention is placed on the lower side of the compressor 20, but may be placed on either the upper side or the lateral side of the compressor 20 only if its structure allows the heat-exchange with contacted to the compressor 20.

As set forth before, the working fluid goes through the vaporization and the condensation sequentially during one cycle, and extracts and radiates heat during the phase transfer to prevent the dew from forming on the contact portion of the case 10 and the door 12.

The heat transferring way of the thermosyphon of the embodiment of the present invention is employed in the heat exchanger and the hot line to prevent the dew from forming on the contact portion of the case 10 and the door 12.

In addition, as the waste heat of the compressor is radiated when the waste heat generated from the compressor is transferred to the working fluid, the efficiency of the compressor and the refrigerating cycle are increased.

The first embodiment of the present invention shows the case of a single freezing room and a single cooling room, but it may be employed in the refrigerator comprising a pair of the freezing room and the cooling room on its both sides, right and left, wherein the outflow pipe line is divided into two lines, introduced into the right and left sides, each forming a closed loop, joined into the end of the inflow pipe line, and introduced into the heat exchanger by one single inflow pipe line.

Now herein after, another embodiment of the present invention is illustrated.

Figure 6:
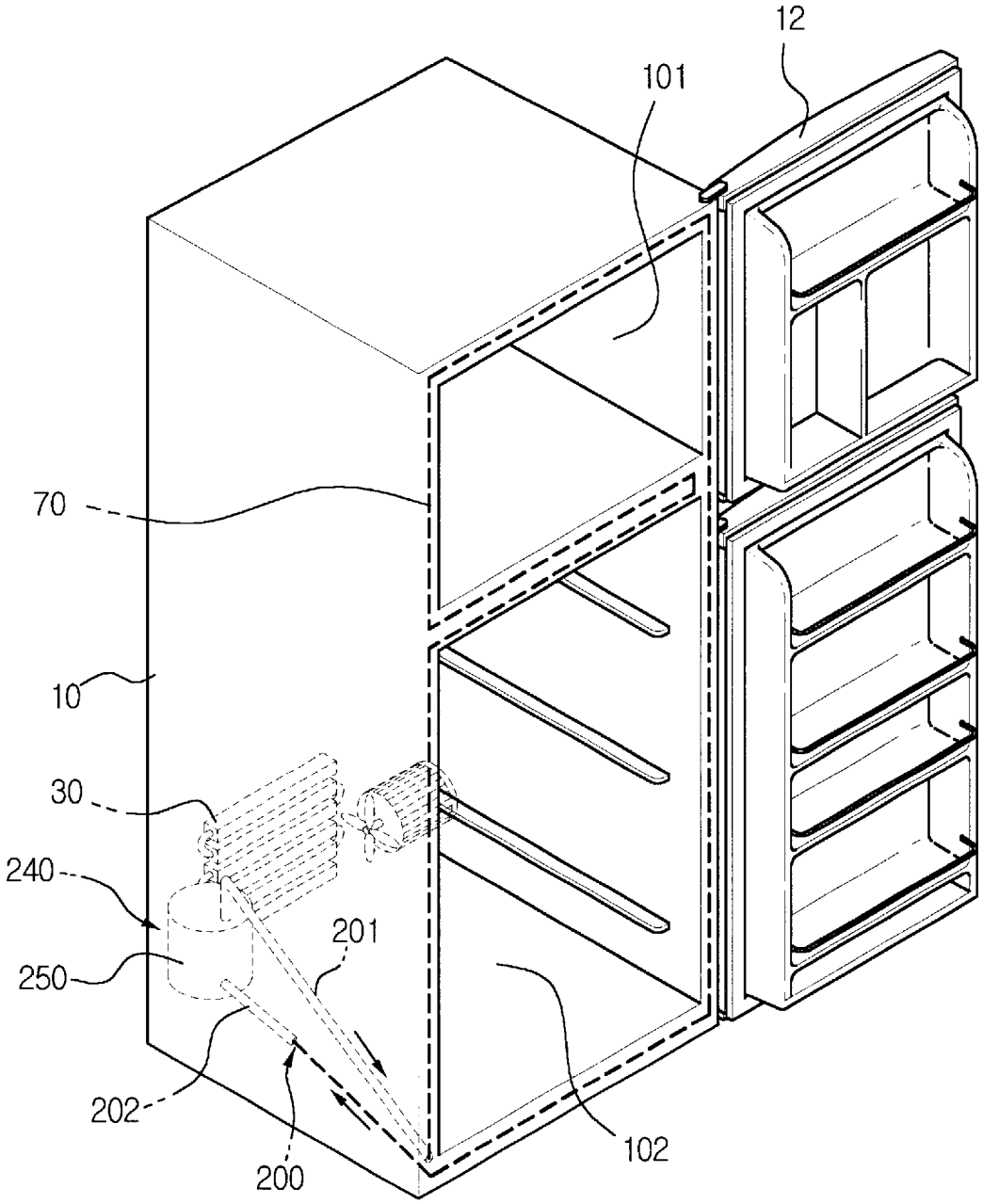
FIG. 6 illustrates that a dewfall preventing device is installed in the refrigerator according to another embodiment of the present invention.

FIG. 6 illustrates that a dewfall preventing device is installed in the refrigerator according to another embodiment of the present invention.

Referring to FIG. 6, a structure of the dewfall preventing device of the refrigerator includes a heat exchanger 240 placed in the machinery room of the rear of the refrigerator, an outflow pipe line 201 formed on the upper side of the heat exchanger 240, and a hot line 70 expanded from the outflow pipe line 201 and placed on the front side of the refrigerator, and an inflow pipe line 202 being connected to the end of the hot line 70 and placed on the lower side of the heat exchanger 210.

The heat circulation cycle formed of the heat exchanger 210 and the hot line 270 is integrally formed with the thermosyphon 200 as a heat transferring device of a closed loop to enable a large amount of heat to be transferred even by a little temperature difference.

The working fluid 220 includes water or methyl alcohol, and vaporization and condensation occur at a low temperature of 0–70° C. in a vacuum state.

Figure 7:
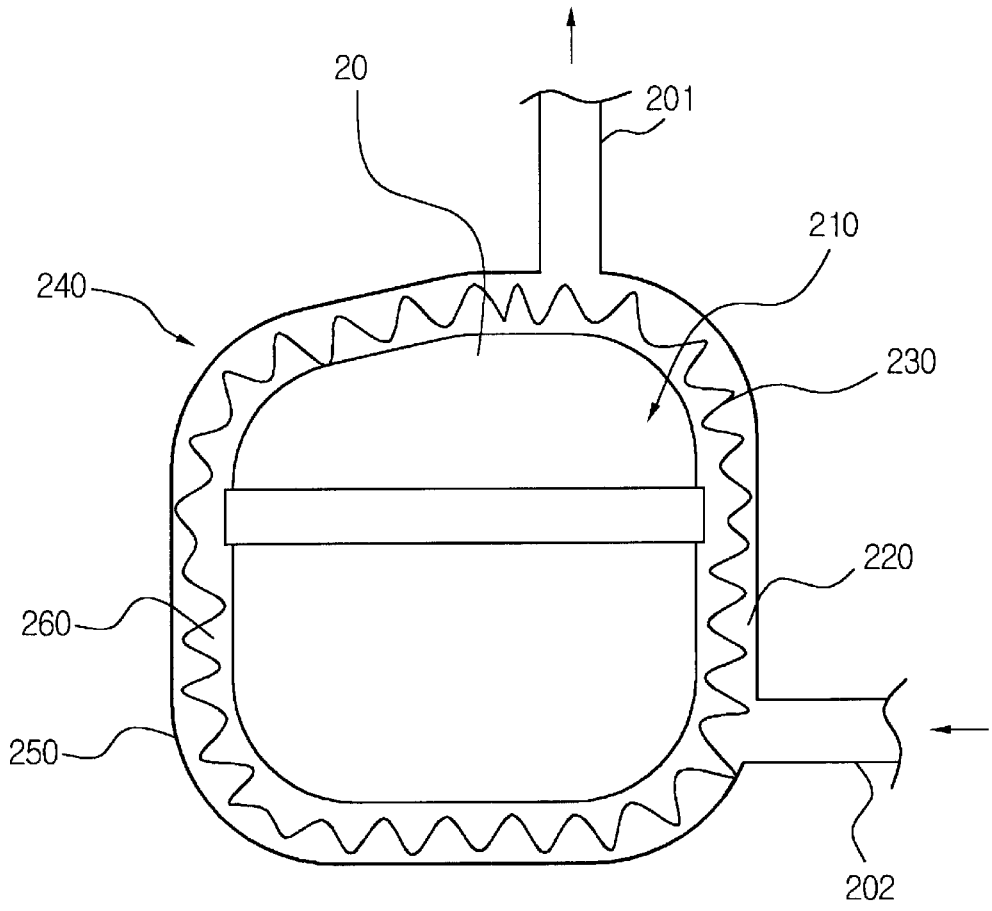
FIG. 7 is a sectional view of a heat exchanger according to another embodiment of the present invention.

FIG. 7 is a sectional view of the heat exchanger of the embodiment of the present invention, and more detailed description will be made referring to the drawing of the heat exchanger in FIG. 6.

Referring to FIG. 7, the heat exchanger 240 is figured in that a double shell 250 has an outflow pipe line 201 on its upper side, and the inflow pipe line 202 on its lower side, a compressor 210 placed to maintain a predetermined interval of a space 260 from the inner wall of the double shell 250, a wick 230 filling the space 260 between the compressor 210 and the double shell 250, and a working fluid 220 moving upward by the capillary phenomenon by the wick 230, and the working fluid being heated and vaporized by the heat exchanger 240.

The compressor 210 keeps a high temperature of the frictional heat generated by the friction of moving parts such as a piston and a cylinder, etc. during the compression process of the refrigerant gas.

The working fluid 220 in the heat exchanger 240 is heated and vaporized by the heat generated from the compressor 20, and the vaporized working fluid 220 moves to the upper side of the heat exchanger 240 by the pressure difference.

The wick 230 is a capillary structure to move upward the working fluid 220 in a liquid state before vaporization.

Figure 8:
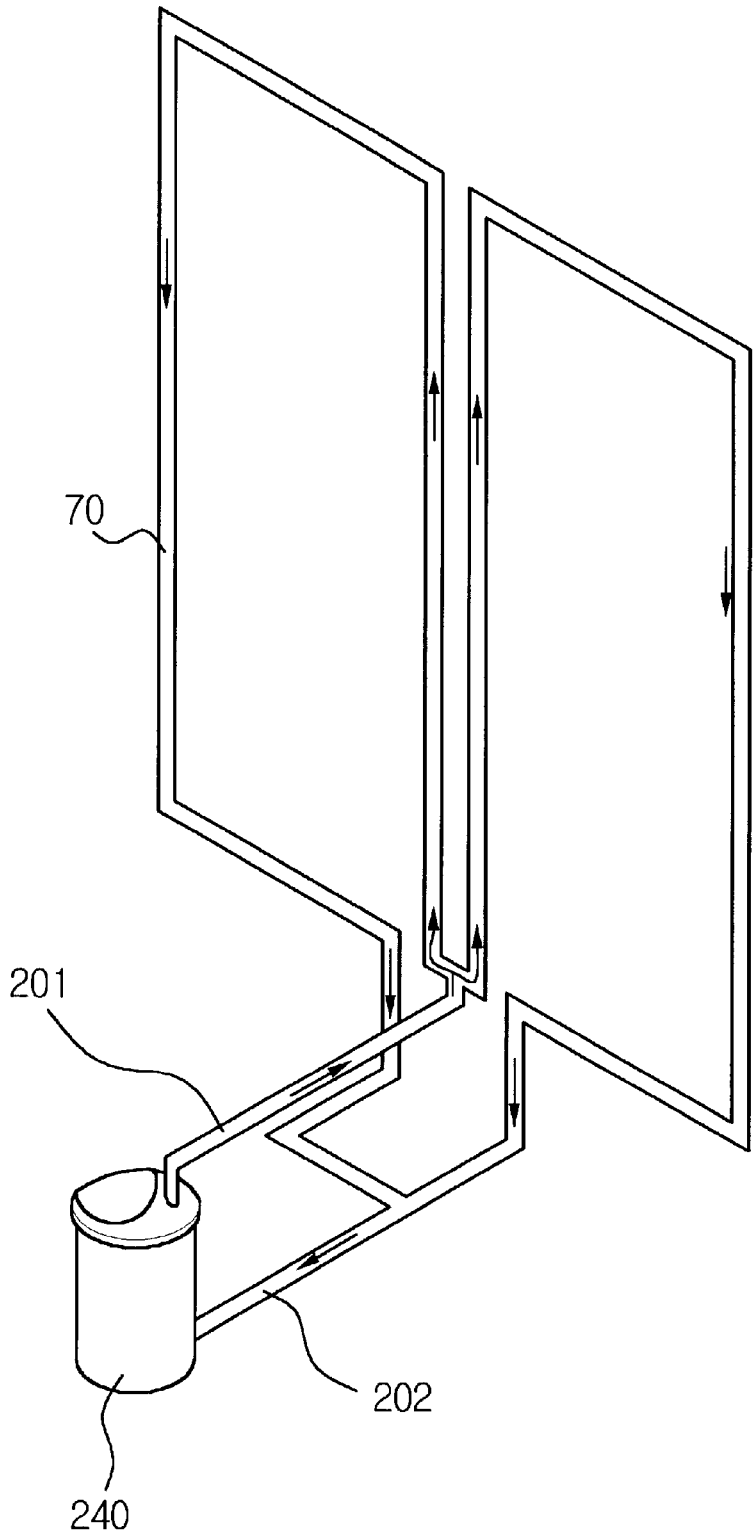
FIG. 8 illustrates a structure of the hot line used in a refrigerator comprising a pair of a freezing room and a cooling room according to another embodiment of the present invention.

FIG. 8 illustrates the hot line 70 used in the refrigerator comprising a pair of the freezing room and the cooling room. The outflow pipe line 201 is extended from one point of the heat exchanger 240, and the working fluid, which is heated in the heat exchanger 240 and vaporizes, is discharged through the outflow pipe line 201. The outflow pipe line 201 is extended to the hot line 70, each of the hot line 70 being formed on the front right and left sides of the refrigerator, and the hot line 70 passing each freezing room and each cooling room of the right and left sides is joined to the inflow pipe line 202 of the heat exchanger 240.

With a structure as above, the operation of the dewfall preventing device of the refrigerator of the present invention is illustrated as follows.

First, a compressor 20 is provided to have the space 260 with distanced away from the inner wall of the double shell 250, and the space 260 has the working fluid 220 and the wick 230 filled there inside.

Water or methyl alcohol may be used as the working fluid 220, and water or methyl alcohol can transfer a large amount of heat just by a small temperature difference by vaporization and condensation at a temperature of 0–70° C. in a vacuum state.

The working fluid 220 having material characteristics as above is heated by the heat generated from the compressor, and the heated working fluid 220 is vaporized to move upward and through the outflow pipe line on the upper side of the heat exchanger, and passes the hot line 70 formed on the front side of the refrigerator.

While passing through the hot line 70, the working fluid 220 radiates heat and is condensed.

The condensed liquid state of the working fluid 220 moves downward by gravitation, and comes back into the inflow pipe line 202 of the heat exchanger 240 thereby to repeat the above process and form the heat circulation cycle.

As the present invention illustrated as above uses the hot line incorporating the thermosyphon not by refrigerant gas, it contributes to decreasing the destruction of the ozone layer, and also makes it possible to easily and efficiently install the thermosyphon without a separate circulation device.

In addition, the heat generated from the compressor is reused as a heating source to operate the thermosyphon thereby to increase the thermal efficiency.

In addition, the present invention provides an effect to cool down the compressor directly by the working fluid which heat-exchanges with the compressor surrounded thereby.

Another embodiment of the present invention is illustrated with reference to the drawings as follows.

Figure 9:
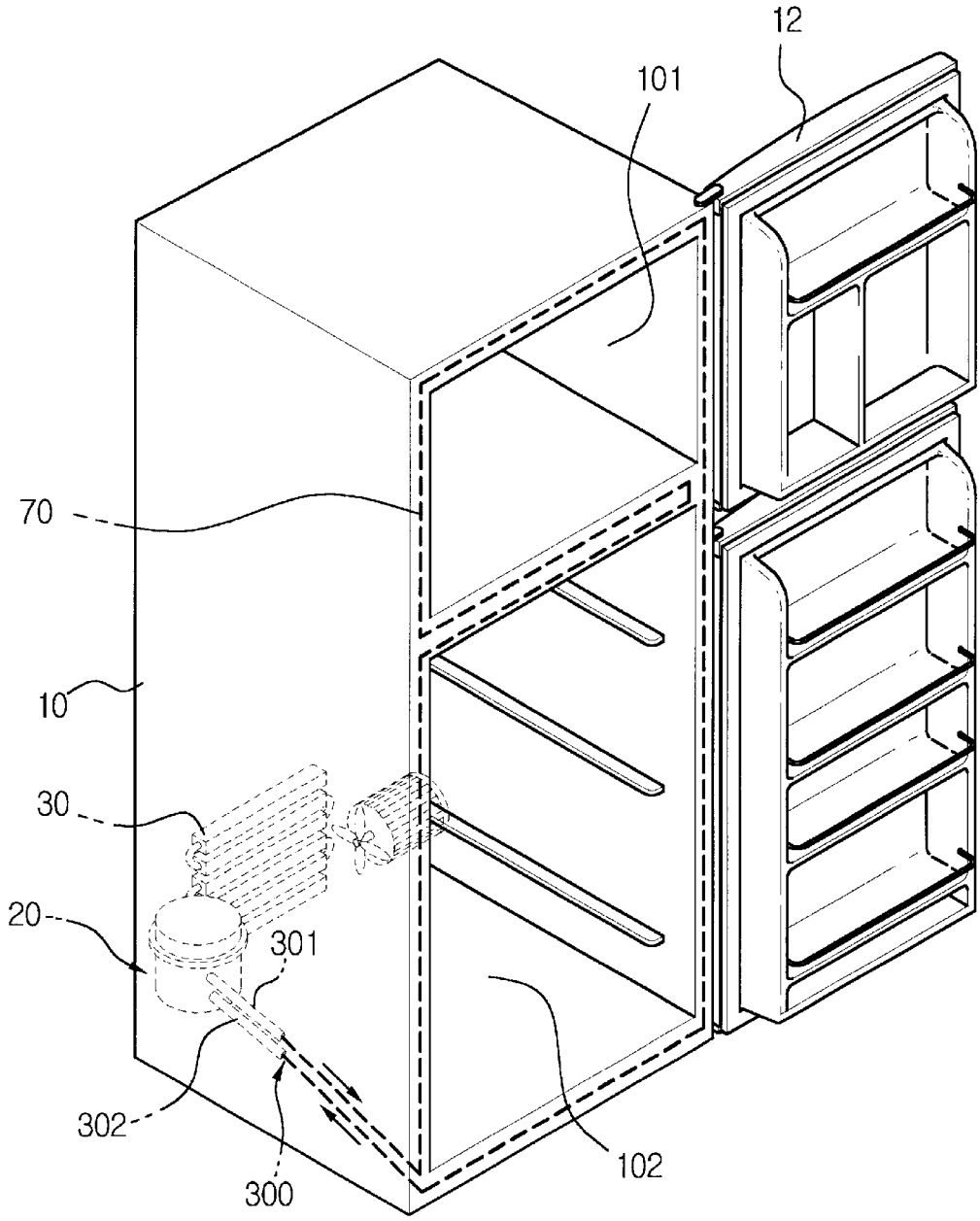
FIG. 9 illustrates that a dewfall preventing device is installed in the refrigerator according to another embodiment of the present invention.

FIG. 9 illustrates a dewfall preventing device of the refrigerator according to another embodiment of the present invention.

Referring to FIG. 9, the hot line 70 of the embodiment of the present invention uses thermosyphon as a heat transferring device to enable a large amount of heat to be transferred even by a small temperature difference.

The working fluid 220 includes water or methyl alcohol, and vaporization and condensation occur at a low temperature of 0–70° C. in a vacuum state.

Figure 10:
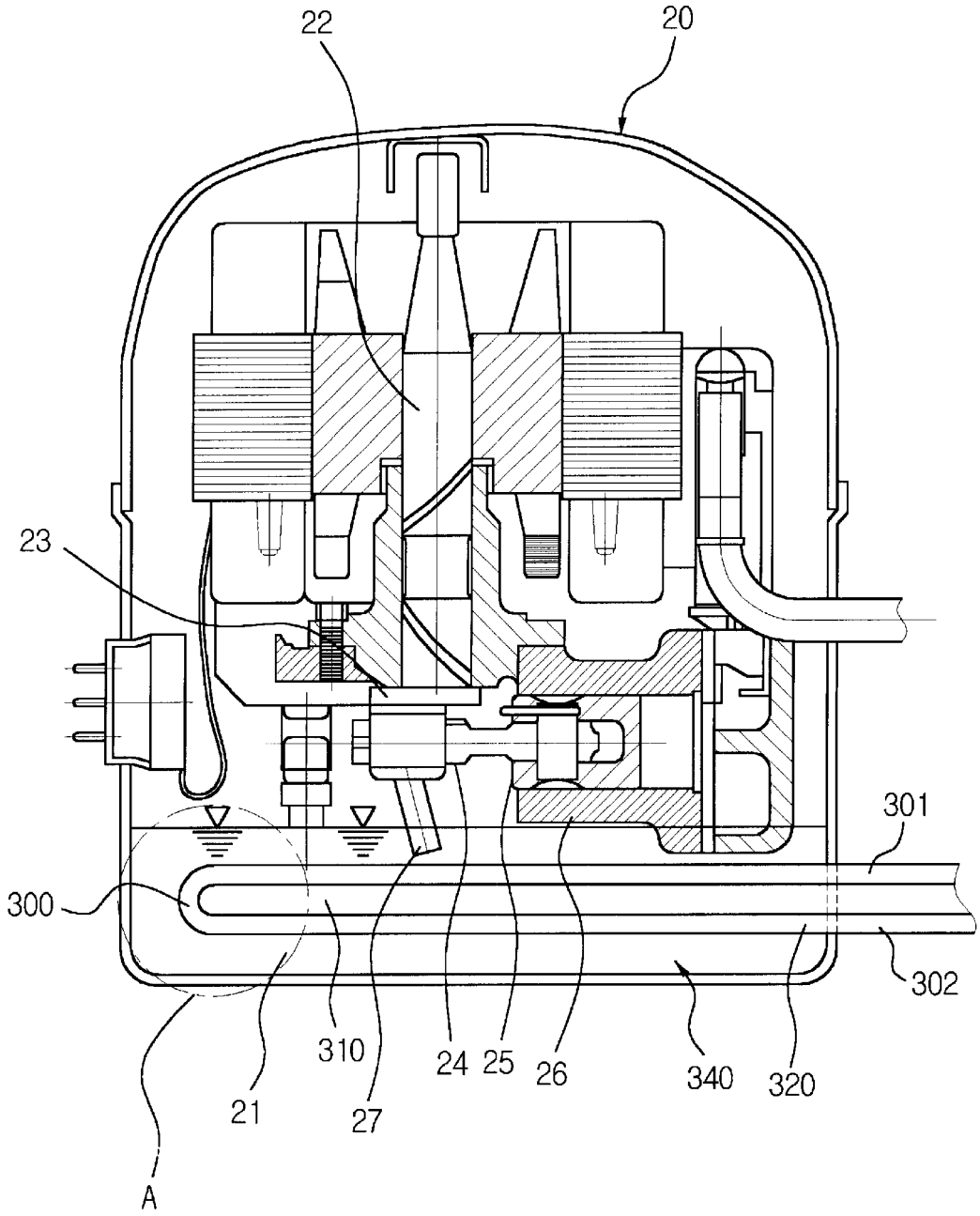
FIG. 10 is a sectional view of a heat exchanger and a compressor according to another embodiment of the present invention.

FIG. 10 is a sectional view of the heat exchanger and the compressor of the embodiment of the present invention.

Referring to FIG. 10, the compressor 20 includes a sealed type compressor 20 which is normally used in the refrigerator.

A high temperature of heat is generated by the friction of the inner wall of the cylinder 26 and the piston 25 during the compression process of the compressor 20, and a cooling oil 21 is used to cool the friction heat and to lubricate the operational parts.

The cooling oil 21 follows a repeated circulation process wherein it is pumped by a typical pumping means, and supplied to the inside of the compressor 20 to lubricate and cool and comes back into the storage part.

However, the temperature of the cooling oil 21 is gradually increased during the repeated process as above, and the cooling efficiency is decreased.

Therefore, the present invention uses the heated cooling oil 21 as a heat exchanger 310 to heat the thermosyphon 300, and accordingly, decreases the temperature of the cooling oil and improves the cooling efficiency of the compressor.

The low temperature of a working fluid 320 in the thermosyphon 300 is introduced into a lower line 302 and heat-exchanges with the heat of the cooling oil 21 in high temperature, and moves to a upper line 301. The cooling oil 21 transfers the heat to the working fluid 320, and decreases its temperature. The working fluid 320 is heated by the heat of the cooling oil 21.

The working fluid 320 is vaporized into a gas, and moves to the hot line 70 of the front side of the refrigerator. While passing through the hot line 70, it radiates the heat to the around. As a result, the contact portion of the refrigerator case and the door is heated by an appropriate temperature, and the working fluid transferring the heat is condensed, and moves down to the lower side by gravitation, and is introduced into the lower line 302.

Figure 11:
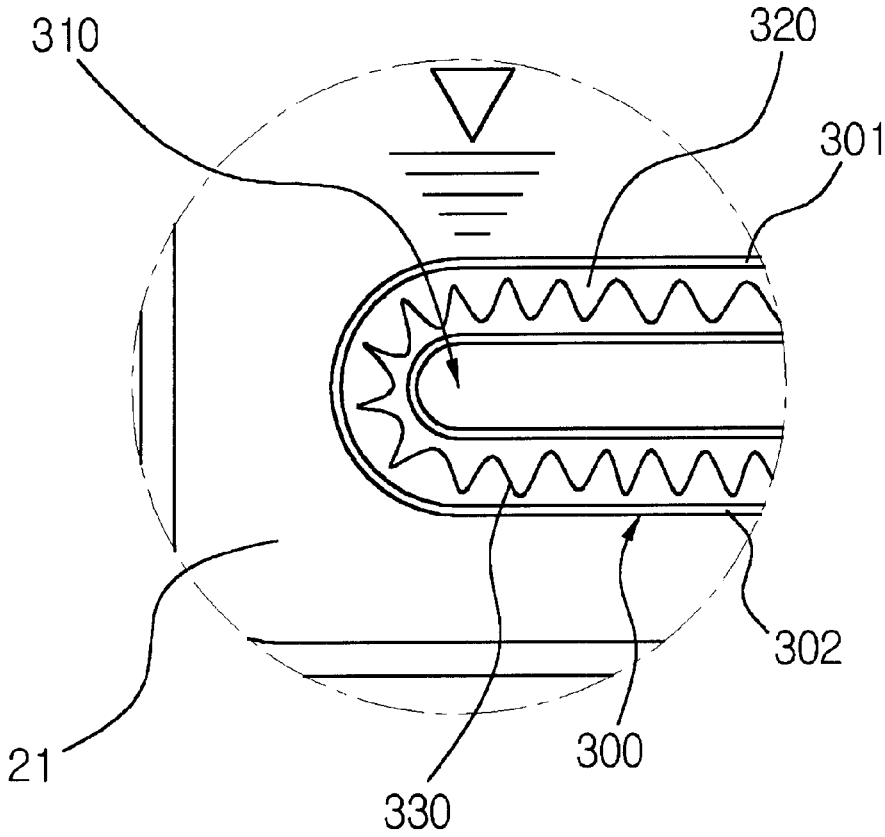
FIG. 11 is a sectional view of a heat exchanger of a thermosyphon according to another embodiment of the present invention.

FIG. 11 is a sectional view of the heat exchanger of the thermosyphon according to the embodiment of the present invention.

Referring to FIG. 11, a capillary fibrous wick 330 is formed inside the thermosyphon 300 inserted into the compressor 20. The working fluid extracts the heat of the compressor from the wick 330, and vaporizes. The vaporized working fluid radiates the heat on the contact portion of the case 10 and the door 12, and is condensed into a liquid state. Then, it is back into the lower line 302 of the heat exchanger 310 by gravitation.

The working fluid 320 back into the lower line 302 of the heat exchanger 310 moves up to the upper line 301 by the capillary phenomenon of the wick 330 in the heat exchanger 310. The working fluid 320 up to the upper line 301 is vaporized and the vaporized working fluid 320 circulates the hot line 70 formed on the front side of the refrigerator.

Figure 12:
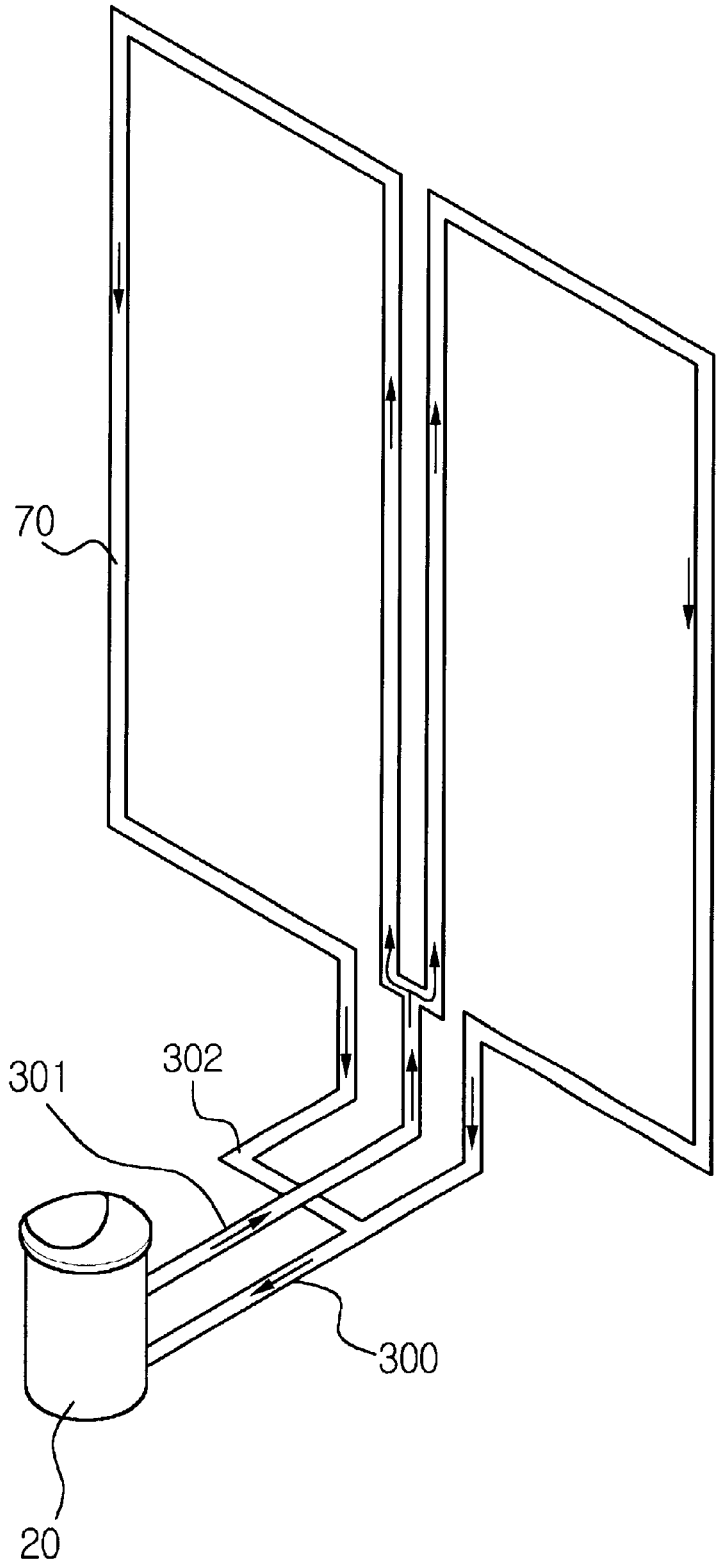
FIG. 12 illustrates a structure of the hot line used in a refrigerator comprising a pair of a freezing room and a cooling room according to another embodiment of the present invention.

FIG. 12 shows the dewfall preventing device of the refrigerator according to another embodiment of the present invention.

Referring to FIG. 12, the hot line 70 is employed on the refrigerator having the freezing room and the cooling room on the right and left sides. The upper line 301 is divided from one point, and the working fluid 320 heated by the heat exchanger 310 is vaporized and discharged there through. The upper line 301 reaches each of the hot line 70 to circulate the front side of each of the freezing room 101 and the cooling room 102, and each hot line 70 circulates each of the freezing room 101 and the cooling room 102, and is joined to the lower line 302 of the heat exchanger 310.

The present invention as above forms the hot line by using thermosyphon with the injected working liquid separately from the cooling gas. Therefore, the air pollution due to the usage of the cooling gas can be decreased.

In addition, according to the present invention, the production process becomes simple because it can be easily installed without an auxiliary circulation device.

In addition, the waste heat of the cooling oil used to cool the compressor is used as a heating source to operate the thermosyphon thereby to efficiently cool the compressor by the working fluid.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dewfall preventing device of a refrigerator having a hot line formed on the front side of a refrigerator case, to vaporize and remove dew forming on the contact portion of the refrigerator case and a refrigerator door, the device comprising:

a heat exchanger placed to contact a compressor of the refrigerator and concentrating the waste heat generated from the compressor; and a thermosyphon, of which both ends are connected to the heat exchanger, and having a working fluid phase-transferred into a gas phase after heat-exchanging with the waste heat from the compressor, being moved along the hot line, to vaporize the dew forming on the contact portion of the refrigerator case and the door by the radiation of the heat, transferred into a liquid phase, fallen down by gravitation, and introduced back into the heat exchanger.

2. The dewfall preventing device of claim 1, wherein the heat exchanger is installed on a lower side of the compressor.

3. The dewfall preventing device of claim 1, wherein the heat exchanger comprises:

a hollow outer housing;

a wick part placed inside the outer housing, for concentrating the waste heat transferred from the compressor, and forcing the working fluid, which heat-exchanges with the waste heat of the compressor, to be discharged into the hot line; and a fluid inflow pipe line and a fluid outflow pipe line having end ports arranged on an inside and an outside of the outer housing respectively, and allowing the working fluid introduced into the outer housing to heat-exchange in the wick part, and be discharged into the hot line therethrough.

4. The dewfall preventing device of claim 3, wherein the end port of the fluid inflow pipe line is formed extended into the heat exchanger with a predetermined length.

5. The dewfall preventing device of claim 3, wherein the fluid outflow pipe line is formed outside the heat exchanger with a predetermined length.

6. The dewfall preventing device of claim 1, wherein the heat exchanger comprises:

a hollow outer housing;

a wick part placed inside the outer housing, for concentrating the waste heat transferred from the compressor, and forcing the working fluid, which heat-exchanges with the waste heat of the compressor, to be discharged into the hot line; and a fluid inflow pipe line and a fluid outflow pipe line having end ports formed on the opposite side to each other centering the wick part to form one directional circulation of the working fluid which is introduced into the heat exchanger through the fluid inflow pipe line without back-flow, heat-exchanges via the wick part, and is discharged into the hot line through the fluid outflow pipe line.

7. The dewfall preventing device of claim 6, wherein the end port of the fluid inflow pipe line is formed extended into the heat exchanger with a predetermined length.

8. The dewfall preventing device of claim 6, wherein the fluid outflow pipe line is formed outside the heat exchanger with a predetermined length.

9. The dewfall preventing device of claim 1, wherein the working fluid is vaporized and condensed at a temperature range of 0–70° C.

10. The dewfall preventing device of claim 1, wherein the working fluid essentially comprises water.

11. The dewfall preventing device of claim 1, wherein the working fluid essentially comprises methyl alcohol.

12. A dewfall preventing device of a refrigerator having a hot line formed on a front side of a refrigerator case, to vaporize and remove dew forming on the contact portion of the refrigerator case and a refrigerator door, the device comprising:

a heat exchanger surrounding the peripheral side of a compressor of the refrigerator and concentrating waste heat generated from the compressor; and a thermosyphon having an inflow pipe line and an outflow pipe line formed on lower side and upper side thereof respectively, and having a working fluid phase-transferred into a gas phase after heat-exchanging with the waste heat from the compressor, and being moved along the hot line to radiate the heat absorbed from the compressor in the hot line.

13. The dewfall preventing device of claim 12, wherein the heat exchanger comprises:

a double shell forming a space part at a predetermined interval between the double shell and the peripheral side of the compressor; and a wick inserted into the space part, for concentrating the waste heat transferred from the compressor and forcing the working fluid, which heat-exchanges with the waste heat of the compressor, to be discharged into the hot line.

14. The dewfall preventing device of claim 12, wherein the heat exchanger comprises:

a double shell formed to surround the compressor, and having an outflow pipe line and an inflow pipe line formed on an upper side and a lower side thereof respectively;

a wick of a capillary structure placed in the space part between the compressor and the double shell; and a working fluid being movable upward by the capillary phenomenon of the wick, and being heated and vaporized by the heat exchanger.

15. The dewfall preventing device of claim 12, wherein the working fluid is vaporized and condensed at a temperature range of 0–70° C.

16. The dewfall preventing device of claim 12, wherein the working fluid essentially comprises water.

17. The dewfall preventing device of claim 12, wherein the working fluid essentially comprises methyl alcohol.

18. A dewfall preventing device of a refrigerator having a hot line formed on a front side of a refrigerator case, to vaporize and remove dew forming on the contact portion of the refrigerator case and a refrigerator door, the device comprising:

a heat exchanger put in the cooling oil of a compressor of the refrigerator to extract waste heat generated from the compressor; and a thermosyphon having a fluid inflow pipe line and a fluid outflow pipe line connected to both ends of the hot line, the fluid inflow pipe line being connected to a lower side of the heat exchange and supplying a working fluid to the heat exchanger, and the fluid outflow pipe line connected to an upper side of the heat exchanger and discharging the working fluid.

19. The dewfall preventing device of claim 18, wherein the heat exchanger is a U-shaped tube to be put into the cooling oil.

20. The dewfall preventing device of claim 18, further comprising a wick arranged inside the heat exchanger to concentrate the heat of the compressor and determine the flowing direction of the working fluid.

21. The dewfall preventing device of claim 18, wherein the working fluid is vaporized and condensed at a temperature range of 0–70° C.

22. The dewfall preventing device of claim 18, wherein the working fluid essentially comprises water.

23. The dewfall preventing device of claim 18, wherein the working fluid essentially comprises methyl alcohol.

24. A dewfall preventing device of a refrigerator comprising:

a compressor for compressing a refrigerant;

a heat exchanger for extracting heat generated due to increase of the refrigerant inner energy by the friction and the compression in the compressor;

a thermosyphon for maintaining a contact portion of a refrigerator case and a refrigerator door at a predetermined temperature by a way that a working fluid phase-transferred into a gas phase in the heat exchanger radiates the extracted heat, and after releasing the extracted heat, the cooled working fluid comes back into the heat exchanger by gravitation; and a wick placed in the pipe line of the heat exchanger, for concentrating the extracted heat generated from the compressor and enabling the working fluid to easily flow.

25. A dewfall preventing method of a refrigerator comprising the steps of:

a) transferring heat generated from a compressor on the lower side of the refrigerator to a heating part of a thermosyphon;

b) heating and vaporizing a working fluid inside the thermosyphon;

c) cooling and liquefying the working fluid in a hot line formed on a contact portion of a refrigerator case and a refrigerator door; and d) having the liquefied working fluid fallen down along the thermosyphon by gravitation, and coming back into the heat exchanger.

* * * * *